US007958874B2

(12) United States Patent
Kobayashi et al.

(10) Patent No.: US 7,958,874 B2
(45) Date of Patent: Jun. 14, 2011

(54) EXHAUST GAS RECIRCULATION APPARATUS

(75) Inventors: Takashi Kobayashi, Okazaki (JP); Osamu Shimane, Kariya (JP)

(73) Assignee: Denso Corporation, Kariya (JP)

( * ) Notice: Subject to any disclaimer, the term of this patent is extended or adjusted under 35 U.S.C. 154(b) by 769 days.

(21) Appl. No.: 12/020,817

(22) Filed: Jan. 28, 2008

(65) Prior Publication Data

US 2008/0184974 A1 Aug. 7, 2008

(30) Foreign Application Priority Data

Feb. 5, 2007 (JP) ..... 2007-025085
Apr. 23, 2007 (JP) ..... 2007-112518

(51) Int. Cl.
*F02M 25/07* (2006.01)

(52) U.S. Cl. ..... 123/568.17; 123/568.15; 123/568.12; 123/568.23; 123/568.25; 123/568.27; 123/568.29

(58) Field of Classification Search ..... 123/568.12, 123/568.11, 568.13, 568.17, 568.18, 568.23, 123/568.25, 568.27, 568.29; 165/103; 60/605.2
See application file for complete search history.

(56) References Cited

U.S. PATENT DOCUMENTS 6,868,841 B2 * 3/2005 Ieda ..... 123/568.12
6,874,488 B2 * 4/2005 Ieda ..... 123/568.27
6,955,213 B2 * 10/2005 Stonehouse et al. ..... 165/103
7,438,062 B2 * 10/2008 Okawa et al. ..... 123/568.12
7,461,641 B1 * 12/2008 Styles et al. ..... 123/568.12
7,581,533 B1 * 9/2009 Moran ..... 123/568.12
2005/0199381 A1 9/2005 Mercz et al.
2008/0236134 A1 * 10/2008 Krueger et al. ..... 60/39.182
2008/0314569 A1 * 12/2008 Yamazaki et al. ..... 165/153
2009/0007891 A1 * 1/2009 Rollet ..... 123/568.12
2009/0038593 A1 * 2/2009 Blumendeller ..... 123/568.12
2010/0116256 A1 * 5/2010 Weis ..... 123/568.23
2010/0126478 A1 * 5/2010 Okawa et al. ..... 123/568.12
2010/0199957 A1 * 8/2010 Furukawa et al. ..... 123/568.12

FOREIGN PATENT DOCUMENTS

EP 0 987 427 1/2004

OTHER PUBLICATIONS

Chinese Office Action dated Mar. 11, 2010, issued in corresponding Chinese Application No. 200810009443.1, with English translation.
Chinese Office Action dated Sep. 2, 2010, issued in corresponding Chinese Application No. 200810009443.1, with English translation.

* cited by examiner

*Primary Examiner* — Thomas N Moulis
*Assistant Examiner* — Raza Najmuddin
(74) *Attorney, Agent, or Firm* — Nixon & Vanderhye PC

(57) ABSTRACT

An exhaust gas recirculation apparatus includes a housing connected with an EGR cooler via a mount face. The housing has a valve chamber accommodating a selector valve. The housing has a partition extending from the mount face close to the valve chamber to divide first and second exhaust ports opened in the mount face. A first passage leads exhaust gas into the EGR cooler through the valve chamber. A second passage recirculates exhaust gas to the intake passage through the EGR cooler and the valve chamber. A bypass passage leads exhaust gas from the engine through the valve chamber to bypass the EGR cooler. A rotation axis of the selector valve is perpendicular to an axis of the mount face, and offset away from the partition.

13 Claims, 9 Drawing Sheets

EXHAUST GAS RECIRCULATION APPARATUS

CROSS REFERENCE TO RELATED APPLICATIONS

This application is based on and incorporates herein by reference Japanese Patent Applications No. 2007-25085 filed on Feb. 5, 2007 and No. 2007-112518 filed on Apr. 23, 2007.

FIELD OF THE INVENTION

The present invention relates to an exhaust gas recirculation apparatus for recirculating exhaust gas of an internal combustion engines from an exhaust passage to an intake passage.

BACKGROUND OF THE INVENTION

Conventionally, an EGR system (exhaust gas recirculation apparatus) is provided to an internal combustion engine such as a diesel engine. The EGR system is adapted to recirculating a part of exhaust gas (EGR gas) of the engine from an exhaust passage to an intake passage so as to reduce emission of the engine. EGR gas contains a large amount of inert gas such as steam, carbon dioxide, and the like after combustion. The EGR system is capable of effectively reducing combustion temperature of the engine, thereby effectively reducing a toxic substance such as nitrogen oxide (NOx) contained in exhaust gas.

The EGR system includes an EGR flow control valve (EGRV) midway through an EGR pipe, which leads EGR gas from the exhaust passage to recirculate the EGR gas to the intake passage. The EGRV controls an amount of the EGR gas returning to the intake passage through an GFR passage in the EGR pipe. The EGR system includes an exhaust gas cooler (EGR cooler) midway through the EGR pipe. The EGR cooler may be a water cooling type heat exchanger. The EGR cooler cools EGR gas, which returns to the intake passage, thereby enhancing a charging efficiency of the engine. Thus, emission of the engine can be effectively reduced.

In the above cooled EGR system, EGR gas is cooled through the EGR cooler, and the cooled gas is recirculated into the intake passage. In view of further emission regulations of an engine such as a diesel engine, a hot EGR system is further needed in addition to the cooled EGR system. The hot EGR system is adapted to leading EGR gas as hot EGR gas to bypass the EGR cooler, and returning the hot EGR gas into the intake passage. The hot EGR system is capable of enhancing combustion in the engine when the engine is started in the cold condition or in regeneration of a diesel particulate filter (DPF).

Specifically, the hot EGR system has a bypass passage in parallel with an EGR passage. EGR passage leads EGR gas from the exhaust passage to recirculate the EGR gas to the intake passage through the EGR cooler. The bypass passage leads EGR gas to bypass the EGR cooler. The hot EGR system is adapted to recirculating EGR gas to the intake passage without passing through the EGR cooler in an engine starting or the like.

Regeneration of the DPF is performed by supplying hot exhaust gas to the DPF so as to heat the DPF such that temperature of the DPF becomes greater than combustion temperature of a particulate matter (PM). The hot EGR system is capable of leading hot EGR gas into the intake passage, thereby enhancing heating of the DPF in regeneration. The hot EGR system is also capable of increasing temperature of intake air drawn into the combustion chamber of the engine. Therefore, the hot EGR system is capable of further effectively heating exhaust gas supplied to the DPF, thereby further effectively reducing emission of the engine.

According to EP0987427, an EGR system is capable of manipulating a flow of cooled EGR gas and a flow of hot EGR gas so as to control temperature of EGR gas returning to an intake passage.

As shown in FIG. 9, the EGR system includes an EGR module constructed of an EGR cooler 101, a housing 102, two passage selector valves (valve plates) 103, 104, a rotation axis 105, and a negative pressure controlled actuator 106. The EGR cooler 101 cools EGR gas using engine cooling water. The housing 102 has therein two first and second valve chambers. The two passage selector valves (valve plates) 103, 104 are respectively accommodated in the first and second valve chambers of the housing 102. The rotation axis 105 supports the passage selector valves 103, 104. The negative pressure controlled actuator 106 drives the rotation axis 105 to manipulate the passage selector valves 103, 104. The EGR cooler 101 has a U-shaped EGR passage having two parallel passages connected via a U-shaped portion. The passage selector valve 103 is coupled to the rotation axis 105 such that the passage selector valve 103 accommodated in the first valve chamber and the passage selector valve 104 accommodated in the second valve chamber form a relative angle (phase difference) of 70 to 90°.

In the present structure, a branch pipe is provided upstream of the housing 102, and a junction pipe is provided downstream of the housing 102 with respect to the flow direction of EGR gas. The housing 102 of the two passage selector valves 103, 104 does not have a branch portion and a junction portion, i.e., merge portion.

The housing 102 has a cooler mount face, a branch-pipe mount face, and a junction pipe mount face respectively provided with two of six EGR ports 111 to 116. The EGR ports 111, 112 are communicated with the first valve chamber. The EGR ports 115, 116 are communicated with the second valve chamber.

The housing 102 has an EGR passage and a bypass passage 123 adjacently extending in parallel with each other. The EGR passage (main passage) leads exhaust gas of the internal combustion engine so as to recirculate the exhaust gas to the intake passage through the EGR cooler 101. The bypass passage 123 leads exhaust gas from the internal combustion engine to recirculate the exhaust gas to the intake passage through the second valve chamber so as to bypasses the EGR cooler 101.

The EGR passage has a cooler inlet gas passage 121 and a cooler outlet gas passage 122. The cooler inlet gas passage 121 leads hot EGR gas discharged from the internal combustion engine into the EGR cooler 101 through the first valve chamber. The cooler outlet gas passage 122 recirculates cooled EGR gas, which is cooled through the EGR cooler 101, to the intake passage.

A partition 124 connects the cooler mount face, to which the EGR cooler 101 is attached, with the passage wall surface defining the bypass passage 123. The partition 124 divides the interior of the housing 102 into the EGR passage and the bypass passage 123. The EGR passage includes the cooler inlet gas passage 121 and the cooler outlet gas passage 122.

In view of mountability to an engine, an EGR module is needed to be downsized by integrating an EGR cooler, a passage selector valve, and EGRV. The EGR module disclosed in EP0987427 has the two passage selector valves 103, 104 provided in the two parallel passages, and the two passage selector valves 103, 104 are connected with the single rotation axis 105. In the present structure, the EGR module is enlarged, and hence mountability to a vehicle such as a car, in particular, an engine is impaired.

In addition, in the EGR module of EP0987427, the cooler mount face is directly connected with the passage wall surface of the bypass passage 123 via the partition 124 of the housing 102. In addition, the rotation axis 105 of the two passage selector valves 103, 104 is in parallel with the axes of the EGR cooler 101 and the housing 102 passing through the center of the cooler mount face. One end of the rotation axis 105 is rotatably supported by a bearing 125 provided in the vicinity of the cooler mount face.

In the present structure, the bypass passage wall surface is directly exposed to hot EGR gas passing through the bypass passage 123, and accordingly, temperature of the bypass passage wall surface increases. The rotation axis 105 and the partition 124 of the housing 102 may be formed of a thermally conductive material. In EP0987427, the housing 102 is formed of an aluminum material. In this case, temperature of the partition 124 of the housing 102 significantly increases due to thermal conduction from hot EGR gas.

When temperature of the partition 124 of the housing 102 increases, temperature of the cooler mount face of the housing 102 also increases. Consequently, temperature of the EGR cooler 101 increases due to heat conduction via the cooler mount face of the housing 102. That is, in the structure of EP0987427, heat of hot EGR gas passing through the bypass passage 123 is easily conducted to the EGR cooler 101 of the EGR module.

When the hot EGR mode is switched to the cooled EGR mode by manipulating the rotation angle of the two passage selector valves 103, 104, cooled EGR gas is recirculated to the intake passage through the EGR cooler 101. In this condition, even engine cooling water is recirculated inside the EGR cooler 101, cooling performance of the EGR cooler 101 is impaired due to thermal conduction from hot EGR gas in the hot EGR mode. As a result, emission cannot be sufficiently reduced.

In addition, when cooled EGR gas and hot EGR gas are mixed and returned to the intake passage so as to control temperature of EGR gas corresponding to the operating condition of the engine, the partition 124 of the housing 102 is transmitted with heat from hot EGR gas passing through the bypass passage 123. Accordingly, the hot EGR gas exerts influence to cooled EGR gas passing through the cooler outlet gas passage 122. Consequently, temperature of the cooled EGR gas passing through the cooler outlet gas passage 122 increases. Accordingly, it is hard to control temperature of mixture of hot EGR gas and cooled EGR gas, which returns to the intake passage. As a result, emission cannot be sufficiently reduced,

SUMMARY OF THE INVENTION

In view of the foregoing and other problems, it is an object of the present invention to produce an exhaust gas recirculation apparatus that includes an exhaust gas cooler having enhanced cooling performance to reduce emission. It is another object of the present invention to produce an exhaust gas recirculation apparatus being readily mounted to an internal combustion engine.

According to one aspect of the present invention, an exhaust gas recirculation apparatus for recirculating exhaust gas of an engine from an exhaust passage to an intake passage, the apparatus comprises an exhaust gas cooler for cooling exhaust gas recirculated to the intake passage. The apparatus further comprises a housing connected with the exhaust gas cooler via a cooler mount face, the housing having a valve chamber communicated with four exhaust ports including first and second exhaust ports, the first and second exhaust ports being adjacent to each other and opened in the cooler mount face. The apparatus further comprises a selector valve rotatably accommodated in the valve chamber for controlling communication among the four exhaust ports. The apparatus further comprises a rotation axis rotatably supporting the selector valve. The housing has a partition extending from the cooler mount face close to the valve chamber, and the partition dividing the first and second exhaust ports. The housing has a first exhaust passage for leading exhaust gas from the engine into the exhaust gas cooler through the valve chamber. The housing further has a second exhaust passage for recirculating exhaust gas, which is cooled in the exhaust gas cooler, to the intake passage through the valve chamber. The housing further has a bypass passage for leading exhaust gas from the engine through the valve chamber to bypass the exhaust gas cooler. The rotation axis is substantially perpendicular to a cooler-mount-face axis passing through a center of the cooler mount face. The rotation axis is offset away from the partition of the housing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment (Construction)

Figure 1:
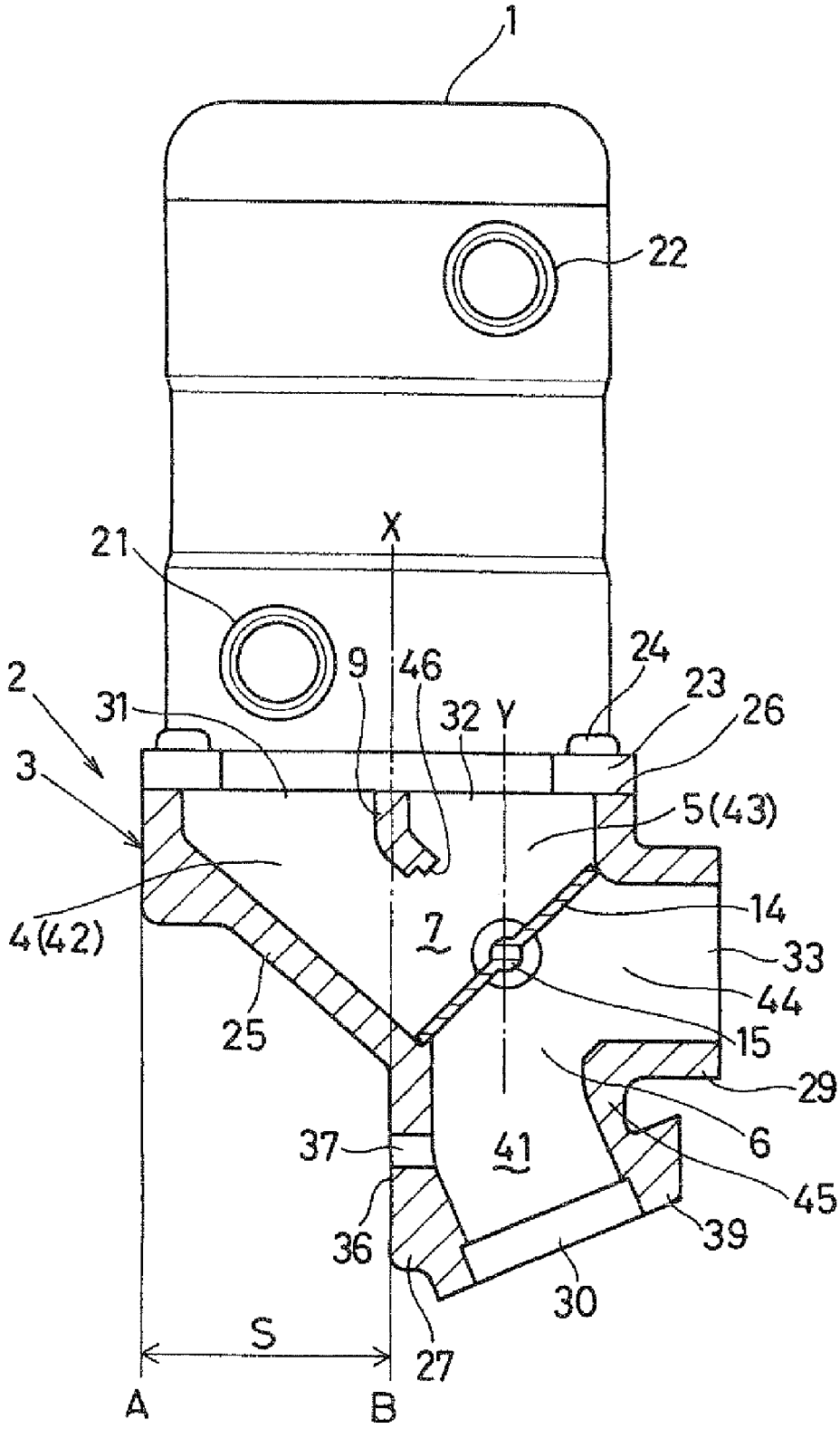
FIG. 1 is a sectional view showing an EGR module according to a first embodiment.

As shown in the FIGS. 1 to 6, in the present embodiment, an internal combustion engine such as a diesel engine is provided with an exhaust gas recirculation system (EGR system) including an exhaust gas recirculation pipe (EGR pipe) and EGR module, for example. The EGR pipe recirculates exhaust gas as EGR gas partially from an exhaust passage of the engine to an air intake passage of the engine. The EGR module is provided midway through the EGR pipe.

The present EGR module includes an exhaust gas cooling device (EGR cooling device) and an exhaust gas control device (EGR control device). The EGR cooling device cools EGR gas recirculated from the exhaust passage to the air intake passage. The EGR control device controls a flow amount and temperature of EGR gas recirculated from the exhaust passage to the air intake passage. The EGR module is constructed by integrating an EGR cooler 1 as an exhaust gas cooler with a valve unit 2. The valve unit 2 is provided with first and second exhaust gas control valves for controlling the flow and temperature of EGR gas.

The valve unit 2 includes a common housing 3 of the first and second exhaust gas control valves. The housing 3 therein defines an exhaust gas passage (EGRV passage) through which EGR gas flows. The EGRV passage includes first and second EGR passages 4, 5 and a bypass passage 6. The EGRV passage (main channel, main route) defines an exhaust gas passage including the first and second EGR passages 4, 5 for recirculating EGR gas. The EGR gas flows from the exhaust passage into the housing 3, and recirculated into the air intake passage through the EGR cooler 1. The bypass passage 6 as the exhaust gas passage defines an EGRV passage (bypass passage, bypass route) for recirculating EGR gas from the exhaust passage to the air intake passage through the housing 3 by bypassing the EGR cooler 1.

The structure of the housing 3 will be described later in detail. An exhaust gas flow control valve (EGR flow control valve, EGRV) as a first exhaust gas control valve controls the flow of the EGR gas passing through the EGRV passage inside the housing 3. In the present embodiment, the EGRV is mounted in the housing 3 commonly with the second exhaust gas control valve. The EGRV includes a first valve (EGR flow rate control valve, flow control valve) 11, a first rotation axis (valve shaft) 12, and a first actuator main body (actuator) 13. The flow control valve 11 is inserted in the EGRV passage of the housing 3. The valve shaft 12 supports the flow control valve 11. The first actuator main body 13 drives the flow control valve 11 via the valve shaft 12. The EGRV is described later in detail. An exhaust gas selector valve (EGR selector valve) as the second exhaust gas control valve is provided for controlling temperature of EGR gas flowing through the EGRV passage of the housing 3.

In the present embodiment, the EGR selector valve is provided in the housing 3 commonly with the EGRV. The EGR selector valve includes a four-way selector valve 14, a second rotation axis as a valve shaft 15, and a second actuator main body 16. The four-way selector valve 14 is inserted in the EGRV passage of the housing 3 downstream of the flow control valve 11 (FIG. 3) with respect to the EGR gas flow. The valve shaft 15 supports the four-way selector valve 14. The second actuator main body 16 drives the four-way selector valve 14 via the valve shaft 15.

The EGR selector valve is described later in detail. In the present embodiment, the valve unit 2 is constructed of the housing 3, the EGRV, and the EGR selector valve. The EGR cooler 1 is a water-cooling exhaust gas cooler for conducting heat exchange between engine cooling water, which flows from an engine water jacket, and EGR gas, thereby cooling the EGR gas to temperature less than predetermined temperature. The EGR cooler 1 is airtightly joined with a cooler mount face of the housing 3.

The EGR cooler 1 includes a casing and a stacked core portion (not shown). The casing is in the shape of a rectangular pipe having one axial open end. The stacked core portion is constructed by stacking multiple flat tubes in the thickness direction thereof, and the flat tubes are adapted to leading EGR gas. Each flat tube is inserted with an offset-type inner fin for enhancing heat exchange. Each flat tube has a U-shaped EGR passage 20 (FIGS. 4, 6) having two parallel passages connected via a U-shaped portion. The stacked core portion has multiple cooling-water passages (not shown) through which engine cooling water circulates around the circumference of the multiple flat tubes.

The casing of the EGR cooler 1 has a cooling-water inlet hole and a cooling-water outlet hole. The cooling-water inlet hole of the casing is connected with an inlet pipe 21 for leading engine cooling water into the multiple cooling-water passages. The cooling-water outlet hole of the casing is connected with an outlet pipe 22 for leading engine cooling water from the multiple cooling-water passages. The upper wall of the casing and the stacked core portion therebetween define an inlet tank chamber and an outlet tank chamber, which were divided with a partition (not shown). The inlet tank chamber communicates the cooling-water inlet hole of the casing with the multiple cooling-water passages. The outlet tank chamber communicates the cooling-water outlet hole of the casing with the multiple cooling-water passages.

The casing has an end on the side of the housing, and the end is integrally formed with a joint portion, which has a joint face joined with the cooler mount face of the housing 3. The joint portion has an exhaust gas inlet hole (EGR inlet hole) and an exhaust gas outlet hole (EGR outlet hole) on the housing mount face. The EGR inlet hole serves as an inlet of the EGR cooler 1, and the EGR outlet hole serves as an outlet of the EGR cooler 1. The inlet and the outlet of the EGR cooler 1 communicate with the U-shaped EGR passage 20 of each stacked core portion.

The joint portion of the casing has a flange 23 radially projected beyond the outer wall of the casing. The flange 23 has multiple bolt holes (not shown) each inserted with a screw bolt 24. The EGR cooler 1 is screwed to the cooler mount face of the housing 3 with the screw bolts 24 in a state where the housing mount face of the joint portion of the casing is tightly in contact with the cooler mount face of the housing 3. A sealing member such as a gasket or a packing may be interposed between the housing mount face of the EGR cooler 1 and the cooler mount face of the housing 3 so as to restrict leakage of EGR gas.

The housing 3 is integrally formed of a metallic material such as cast iron to be in a predetermined shape. The housing 3 is provided midway through the EGR pipe. The housing 3 includes a block 25 as a housing body having a hollow portion as a valve chamber 7. The block 25 has a cooler mount face 26, to which the flange 23 of the joint portion of the EGR cooler 1 is attached. In the present embodiment, the block 25 is integrally formed with a cylindrical inlet pipe 27 and a cylindrical outlet pipe 29. The inlet pipe 27 is projected from the block 25 toward the exhaust passage upstream with respect to the flow direction of EGR gas. The outlet pipe 29 is projected from the block 25 toward the air intake passage downstream with respect to the flow direction of EGR gas.

The valve chamber 7 is communicated with Tour exhaust gas ports. The four exhaust gas ports include an EGR introduction port 30, which has a circular cross section, first and second EGR ports 31, 32, each of which has a rectangular cross section, and an EGR delivery port 33, which has a circular cross section, and the like. The first and second EGR ports 31, 32 are in parallel with each other and open in the cooler mount face 26 of the housing 3. The first EGR port 31 as a cooler inlet port is opposed to the inlet of the EGR cooler 1. The second EGR port 32 as a cooler outlet port is opposed to the outlet of the EGR cooler 1.

A rectangular flange 34 (FIG. 2) is integrally formed with the periphery of the cooler mount face 26 of the block 25. The flange 34 has multiple bolt holes each screwed with the screw bolt 24. The valve chamber 7 of the block 25 has a lateral side portion having a communication hole extending along a rotation axis of the valve shaft 15 of the four-way selector valve 14. The communication hole is provided inside a plug 35. The plug 35 airtightly blockades a circular opening in an outer wall of the housing 3.

The inlet pipe 27 has a first joint face upstream of the valve chamber 7 with respect to the flow direction of EGR gas. The inlet pipe 27 is attached to an EGR pipe on the side of an exhaust passage or a branch portion of the engine exhaust pipe, in particular a branch portion of the exhaust manifold, via the first joint face. The outer circumferential periphery of the inlet pipe 27 has a flat actuator mount face 36 to which the first actuator main body 13 is mounted. The inlet pipe 27 has a communication hole 37. The communication hole 37 extends along the rotation axis of the valve shaft 12 of the flow control valve 11 to communicate the actuator mount face 36 with a wall surface defining the passage in the inlet pipe 27.

The outer circumferential periphery of an opening end of the inlet pipe 27 is integrally formed with multiple protrusions 39. The protrusions 39 respectively have screw holes 40 into which screw bolts are screwed to fix the inlet pipe 27 with an EGR pipe on the side of the exhaust passage. The outlet pipe 29 has a second joint face downstream of the valve chamber 7 with respect to the flow direction of EGR gas. The outlet pipe 29 is attached to an EGR pipe on the side of the intake passage or a merge portion of the engine intake pipe, in particular a merge portion of the intake manifold.

The first EGR passage 4 as a first exhaust gas passage (cooler introduction path) leads EGR gas into the EGR cooler 1 through the valve chamber 7. The first EGR passage 4 has an inclined passage, which substantially linearly extends from a portion in the vicinity of the EGR introduction port 30 toward the first EGR port 31. The inclined passage of the first EGR passage 4 is inclined with respect to a center axis of the first EGR port 31. The center axis of the first EGR port 31 passes through the center of the first EGR port 31.

The second EGR passage 5 as a second exhaust gas passage (cooler delivery path) leads EGR gas cooled in the EGR cooler 1 to recirculate the EGR gas into the intake passage through the valve chamber 7. The second EGR passage 5 has a bent passage, which is bent in the valve chamber 7 at a substantially right angle. The second EGR passage 5 may have a curve passage, which gently curves in the bent passage. The bypass passage 6 as a cooler bypass passage (cooler bypass path) leads EGR gas through the valve chamber 7 to bypass the EGR cooler 1. The bypass passage 6 has a bent passage, which is bent in the valve chamber 7 at a substantially right angle. The bypass passage 6 may have a curve passage, which gently curves in the bent passage.

The first EGR passage 4 and the bypass passage 6 have the EGR introduction port 30 upstream of the valve chamber 7 with respect to the flow direction of EGR gas. The EGR introduction port 30 opens in the first joint face of the housing 3. The first EGR passage 4 and the bypass passage 6 commonly have both the EGR introduction port (common exhaust gas inlet) 30 and a first communication passage (first common passage) 41, which communicates the EGR introduction port 30 with the valve chamber 7.

The first EGR passage 4 has the first EGR port 31 downstream of the valve chamber 7 with respect to the flow direction of EGR gas. The first EGR port 31 opens in the cooler mount face 26 of the housing 3. In the present embodiment, a first communication passage 42 is provided in the vicinity of the cooler mount face 26 of the housing 3 to communicate the valve chamber 7 with the first EGR port 31. The second EGR passage 5 has the second EGR port 32 upstream of the valve chamber 7 with respect to the flow direction of EGR gas. The second EGR port 32 opens in the cooler mount face 26 of the housing 3. In the present embodiment, a second communication passage 43 is provided in the vicinity of the cooler mount face 26 of the housing 3 to communicate the second EGR port 32 with the valve chamber 7.

The second EGR passage 5 and the bypass passage 6 have the EGR delivery port 33 downstream of the valve chamber 7 with respect to the flow direction of EGR gas. The EGR delivery port 33 opens in the second joint face of the housing 3. The second EGR passage 5 and the bypass passage 6 commonly have both the EGR delivery port (common exhaust gas outlet) 33 and a second communication passage (second common passage) 44, which communicates the valve chamber 7 with the EGR delivery port 33.

The housing 3 has a Y-shaped partition wall 45 (FIG. 1) to divide the first EGR passage 4 from the second EGR passage 5. The housing 3 has a partition 9 as a part of the partition wall 45. The partition 9 is in a bent shape to divide the first EGR port 31 from the second EGR port 32. The partition 9 airtightly partitions the first communication passage 42, which has the first EGR port 31 on the side of the cooler mount face 26 with respect to the valve chamber 7, from the second communication passage 43 including the second EGR port 32. The partition wall 45 has an opening 46, which communicates the first EGR passage 4 with the second EGR passage 5.

The partition 9 extends from the cooler mount face 26 toward the valve chamber 7. The partition 9 includes a linear portion and an inclined portion. The liner portion of the partition 9 extends along the center axis of the EGR cooler l, the center axis of the EGR cooler 1 passing through the center of the joint face of the EGR cooler 1 perpendicularly to the joint face of the EGR cooler 1. The liner portion of the partition 9 is on the same axis as the center axis (cooler-mount-face axis) X of the cooler mount face 26 passing through the center of the cooler mount face 26. The inclined portion of the partition 9 is on the same axis as the axis passing through the center of the center of the opening 46, i.e., the center of the valve chamber 7. The partition 9 has an intermediate portion between the linear portion and the inclined portion, and the partition 9 is bent at the intermediate portion. The inclined portion of the partition 9 is inclined a predetermined angle of inclination toward the center axis (second-exhaust-port axis) Y of the second EGR port 32 of the center axis Y passing through the center of the second EGR port 32 with respect to the center axis of the EGR cooler 1 and the center axis X of the cooler mount face 26.

The valve chamber 7 of the housing 3 has the center, which corresponds to the center of the opening 46. The center of the valve chamber 7 is offset from the center axis of the EGR cooler 1 and the center axis X of the cooler mount face 26 to the center axis Y of the second EGR port 32 by a predetermined offset amount. The center of the valve chamber 7 is offset away from the partition of the housing 3 by a predetermined offset amount. The valve chamber 7 of the housing 3 has first to fourth communication holes. The first communication hole communicates with the EGR introduction port 30 through the first communication passage 41. The second communication hole communicates with the first EGR port 31 through the first communication passage 42. The third communication hole communicates with the second EGR port 32 through the second communication passage 43. The fourth communication hole communicates with the EGR delivery port 33 through the second communication passage 44.

The block 25 of the housing 3 is provided with an EGR temperature sensor 49 (FIG. 2) such as a thermistor. The EGR temperature sensor 49 detects temperature of EGR gas, which flows from the outlet of the EGR cooler 1 into the second EGR passage 5 (second communication passage 43) through the second EGR port 32. The EGR temperature sensor 49 converts the temperature of EGR gas into an electric signal, and outputs the electric signal to an engine control unit (ECU).

The partition 9 of the housing 3 has a first valve seat portion 51. The four-way selector valve 14 has a seal portion, and the seal portion is seated to the first valve seat portion 51 when the four-way selector valve 14 communicates the first and second EGR passages 4, 5 and blocks the bypass passage 6. The housing 3 has a passage wall surface opposed to the first valve seat portion 51 via the second communication hole, and the passage wall surface has a second valve seat portion 52. The seal portion of the four-way selector valve 14 is seated to the second valve seat portion 52 when the four-way selector valve 14 blocks the two first and second EGR passages 4, 5 and communicates the bypass passage 6.

The EGRV includes the flow control valve 11, the valve shaft 12, the spring (not shown), and the first actuator main body 13. The flow control valve 11 is accommodated in the first communication passage (EGRV passage) 41 of the housing 3 such that the flow control valve 11 is capable of opening and closing the first communication passage 41. The flow control valve 11 rotates integrally with the valve shaft 12. The spring (not shown) biases the flow control valve 11 to a closing direction. The first actuator main body 13 manipulates the flow control valve 11. The flow control valve 11 is rotated around the rotation axis of the valve shaft 12 and the rotation angle of the flow control valve 11 is changed, such that the flow control valve 11 continuously changes the opening of the first communication passage 41 of the housing 3. Thus, the flow control valve 11 arbitrarily and variably controls the flow amount of EGR gas returning from the exhaust passage into the intake passage.

The flow control valve 11 is fixed to a tip end of the valve shaft 12 in a state where the flow control valve 11 is inclined with respect to the valve shaft 12 at a predetermined angle of inclination. The flow control valve 11 has an outer circumference end surface equipped with a seal ring 53. The inner wall surface of the inlet pipe 27 of the housing 3 is press-fitted with a cylindrical nozzle 54 formed of a metallic material such as stainless steel excellent in heat resistance and corrosion resistance. The nozzle 54 is inserted in only a sliding part on which a sliding surface of the seal ring 53 slides when the flow control valve 11 is rotated around a full-close position.

The valve shaft 12 of the flow control valve 11 is inserted straight along the axis of the communication hole 37 to pass through the communication hole 37. The valve shaft 12 is extends from the outside of the inlet pipe 27 of the housing 3 into the inside of the first communication passage 41.

The first actuator main body 13 is a housing member having an opening closed with a sensor cover 55. The first actuator main body 13 is formed by die-casting of aluminum alloy, which contains aluminum as a main component. The first actuator main body 13 is screwed with multiple screw bolts tightly to the actuator mount face 36 of the inlet pipe 27 of the housing 3, thereby joined with the housing 3. The first actuator main body 13 accommodates an electric motor and a transmission device The electric motor such as a DC motor generates driving force by being supplied with electricity. The transmission device such as reduction gears transmits the driving force of the electric motor to the valve shaft 12. An oil seal, a ball bearing, or the like is press-fitted between the valve shaft 12 of the flow control valve 11 and a bearing of the first actuator main body 13.

Figure 3:
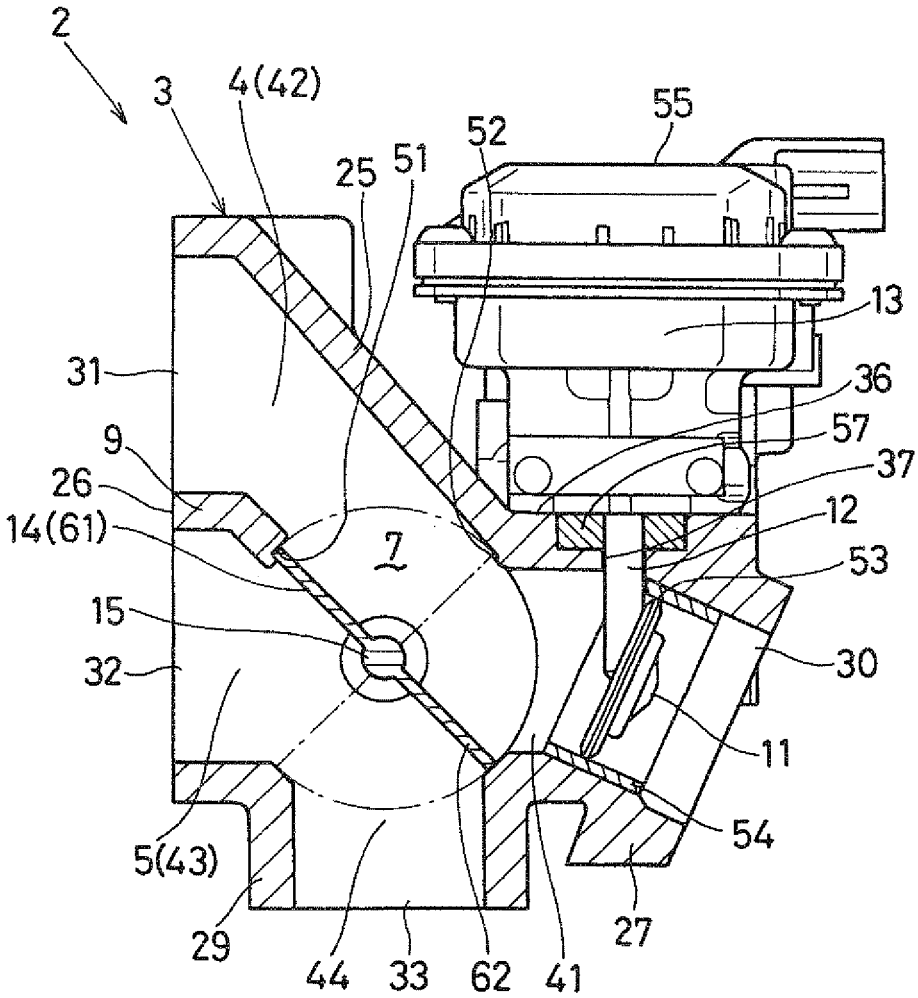
FIG. 3 is a sectional view showing a valve unit of the EGR module, according to the first embodiment.

As shown in FIG. 3, a bearing member such as a bushing 57 is press-fitted between the inlet pipe 27 of the housing 3 and the valve shaft 12 of the flow control valve 11. The bushing 57 has a slide hole for rotatably supporting the valve shaft 12 of the flow control valve 11. The outer circumferential periphery of the valve shaft 12 and the inner circumferential periphery of the wall surface of the slide hole of the bushing 57 therebetween define a substantially cylindrical gap (clearance), via which the valve shaft 12 is rotatably supported by the bushing 57, A sealing member such as a gasket or a packing is interposed between the actuator mount face 36 of the inlet pipe 27 of the housing 3 and a housing joint face of the first actuator main body 13 so as to restrict leakage of EGR gas.

In the present embodiment, an EGR flow rate sensor is mounted to the first actuator main body 13. The EGR flow rate sensor converts rotation angle (valve opening) of the flow control valve 11 into an electric signal, and outputs the electric signal, which indicates the valve opening of the flow control valve 11, to the ECU. In the present structure, in addition to the first actuator main body 13, the EGR flow rate sensor is mounted to the housing 3 of the EGR module.

The EGR selector valve is constructed of the four-way selector valve 14, the valve shaft 15, and the second actuator main body 16. The four-way selector valve 14 is rotatably accommodated in the valve chamber 7 of the housing 3 such that the four-way selector valve 14 is capable of switching the passages. The valve shaft 15 rotates together with the four-way selector valve 14. The second actuator main body 16 drives the four-way selector valve 14. The four-way selector valve 14 is formed of a metallic material such as stainless steel excellent in heat resistance and corrosion resistance. The four-way selector valve 14 is rotatable in the valve chamber 7 of the housing 3. The four-way selector valve 14 arbitrarily switches communication among four exhaust ports by rotating around the rotation axis of the valve shaft 15 in the valve chamber 7.

The four-way selector valve 14 is a butterfly valve constructed of valve plates each being in a rectangular shape. The valve plates of the four-way selector valve 14 are extended toward both sides perpendicularly to the rotation axis of the valve shaft 15. That is, the valve plates are extended toward both sides along the radial direction of the rotation axis of the valve shaft 15. The valve plates of the four-way selector valve 14 include first and second metal plates 61, 62. The first metal plate 61 has an outermost portion provided with a seal portion, which is seated selectively to one of the first and second valve seat portions 51, 52.

The four-way selector valve 14 is capable of variably controlling openings of the first and second EGR passages 4, 5 and the bypass passage 6 according to the switching position thereof. In the present structure, the four-way selector valve 14 is capable of variably controlling a mixing ratio between cooled EGR gas and hot EGR gas. The cooled EGR gas is cooled in the EGR cooler 1 when passing through the first and second EGR passages 4, 5. The hot EGR gas passes through the bypass passage 6 to bypass the EGR cooler. Thus, the four-way selector valve 14 is capable of controlling temperature of EGR gas, which returns to the intake passage.

Figure 4:
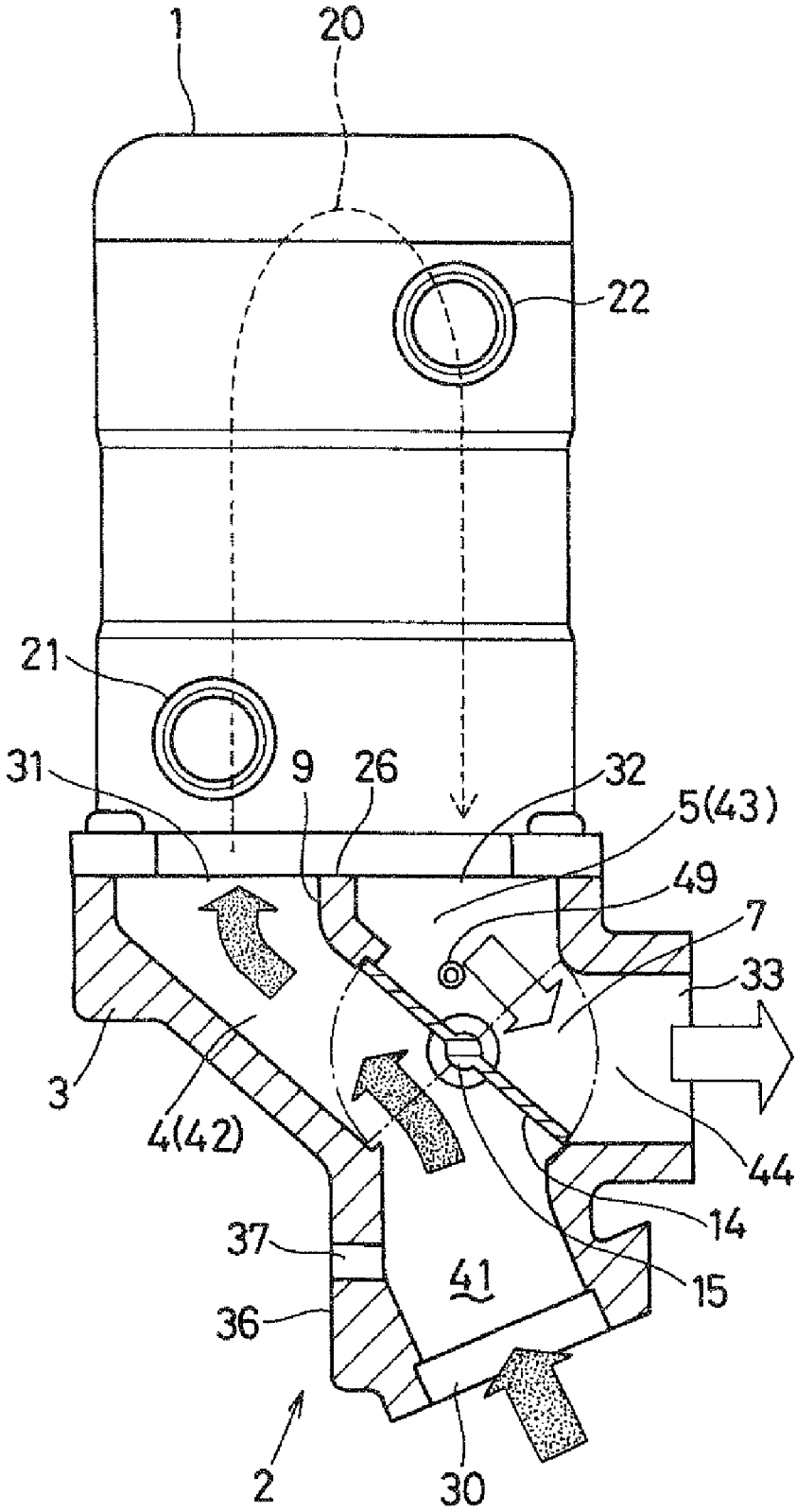
FIG. 4 is a sectional view showing the EGR module in a cooled EGR mode, according to the first embodiment.

As shown in FIG. 4, in a cooled EGR mode, the four-way selector valve 14 as a partition plate divides the valve chamber 7 into the first EGR passage 4 and the second EGR passage 5. In the cooled EGR mode, the four-way selector valve 14 manipulates the communication among the four exhaust gas ports to form the first and second EGR passages 4, 5 inside the housing 3.

Figure 5:
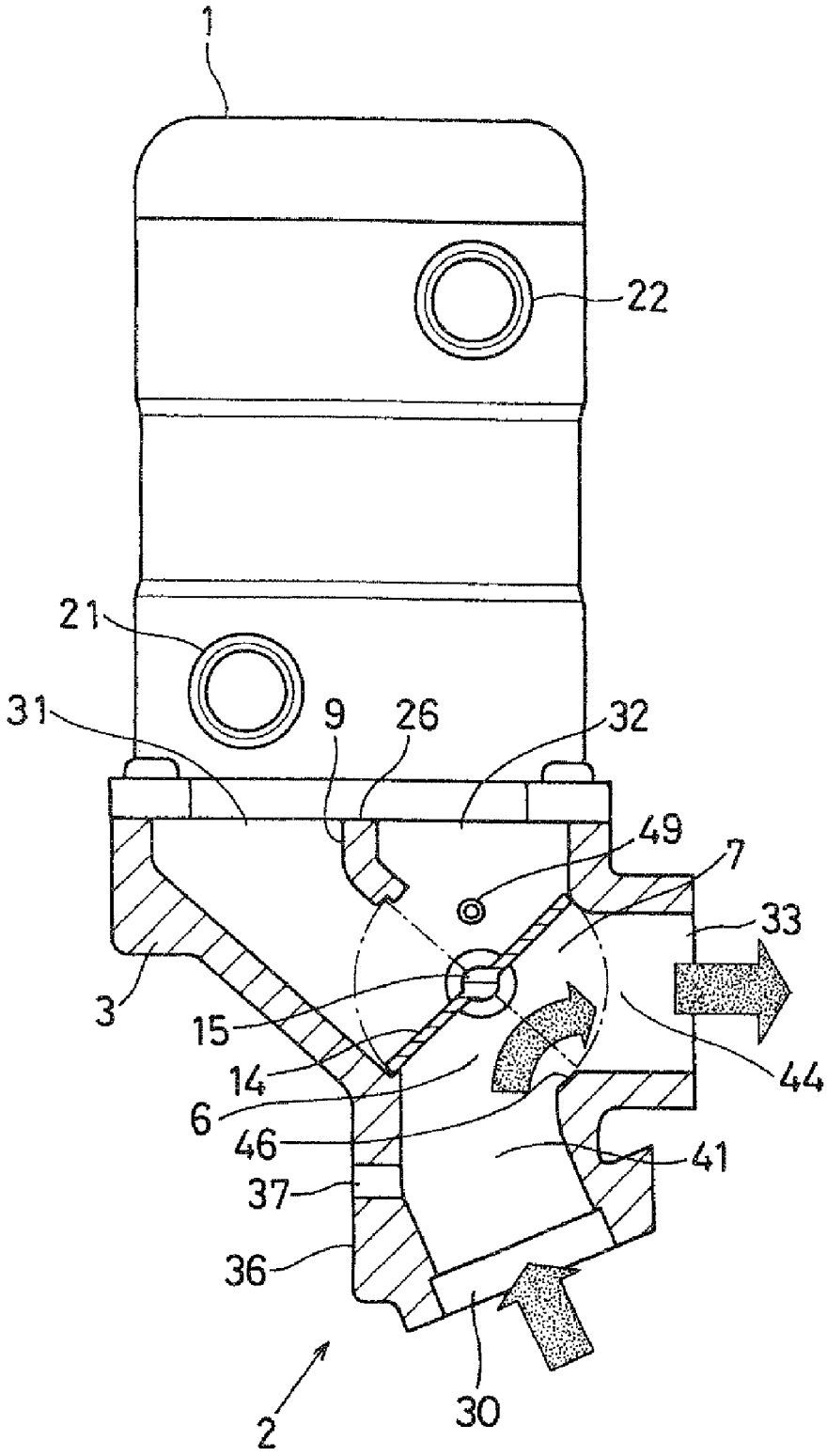
FIG. 5 is a sectional view showing the EGR module in a hot EGR mode, according to the first embodiment.

As shown in FIGS. 1, 5, in a hot EGR mode, the four-way selector valve 14 as a partition plate divides the valve chamber 7 into a portion on the side of the EGR cooler 1 and a portion on the side of the bypass passage 6. That is, in the hot EGR mode, the four-way selector valve 14 divides the valve chamber 7 into a portion on the side of the partition 9 of the housing 3 and a portion on the side of the bypass passage 6. In the hot EGR mode, the four-way selector valve 14 manipulates the communication among the four exhaust gas ports to form the bypass passage 6 inside the housing 3.

Figure 6:
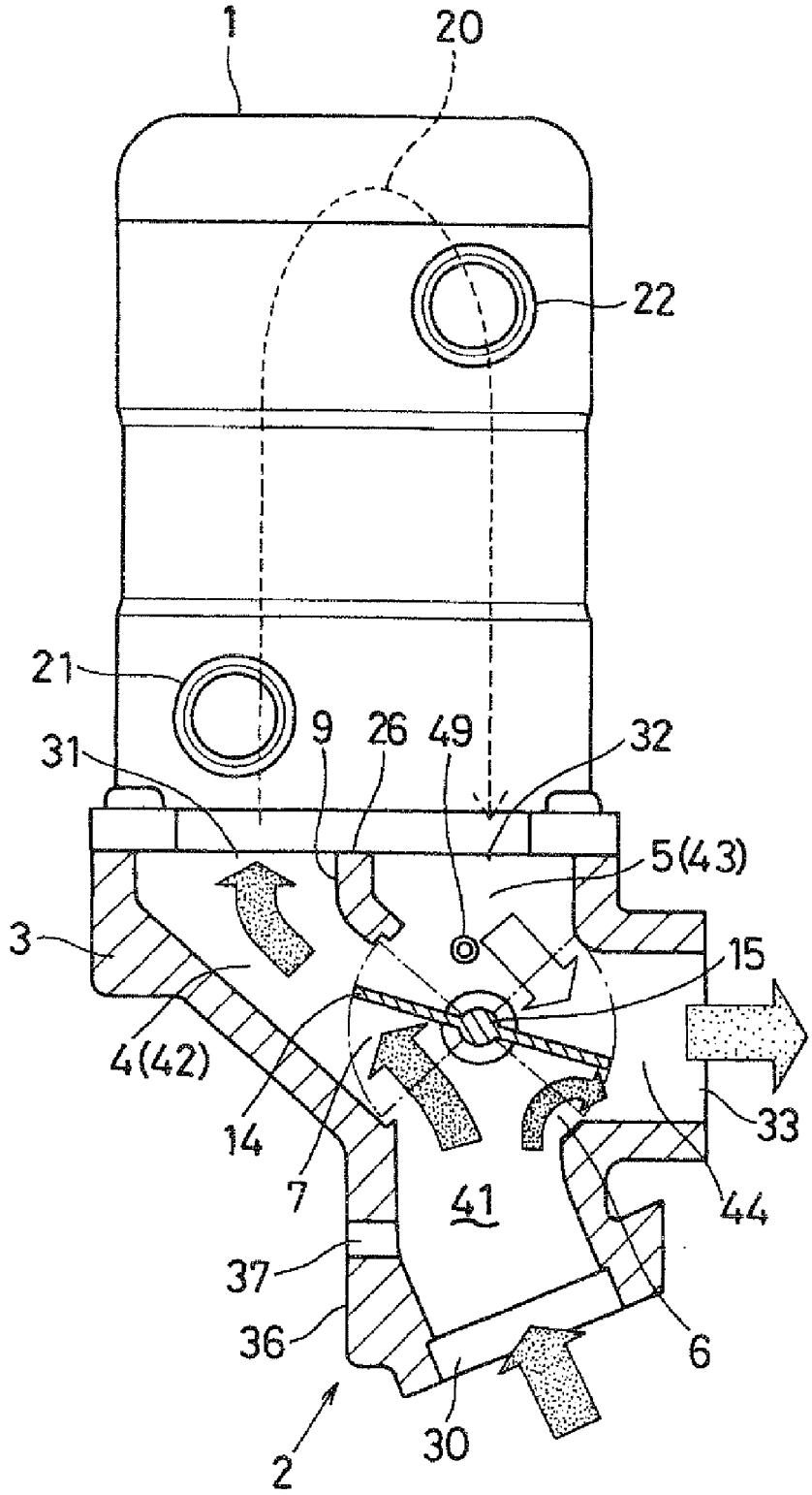
FIG. 6 is a sectional view showing the EGR module in a hot-cooled EGR mixing mode, according to the first embodiment.

In the present embodiment, as shown in FIGS. 4 to 6, the four-way selector valve 14 is capable of continuously rotating in the range from a bypass full-close position and a bypass full-open position. Specifically, as shown in FIG. 4, in the cooled EGR mode, the cooled EGR gas passes at a maximum flow amount in a condition where the four-way selector valve 14 is in the bypass full-close position. Alternatively, as shown in FIG. 5 in the hot EGR mode, the hot EGR gas passes at a maximum flow amount in a condition where the four-way selector valve 14 is in the bypass full-open position. FIG. 6 shows an example of a hot-cooled EGR mixing mode in which the four-way selector valve 14 is in a middle position between the bypass full-close position and the bypass full-open position. In this hot-cooled EGR mixing mode, the four-way selector valve 14 is in a mixing position and the hot EGR gas and the cooled EGR gas are mixed in the valve chamber 7.

The valve shaft 15 of the EGR selector valve (four-way selector valve) 14 is formed of a metallic material such as stainless steel excellent in heat resistance and corrosion resistance. The valve shaft 15 is in a cylindrical shape and is straightly inserted along the axial direction of the communication hole from the exterior of the block 25 of the housing 3 into the valve chamber 7 inside of the block 25. That is, the valve shaft 15 passes through the communication hole provided in the block 25 of the housing 3. The valve shaft 15 has a tip end welded and fixed to the first and second metal plates 61, 62 of the four-way selector valve 14. The valve shaft 15 is offset from the center axis of the EGR cooler 1 and the center axis X of the cooler mount face 26 to the center axis Y of the second EGR port 32 by a predetermined offset amount. The valve shaft 15 is offset away from the EGR cooler 1 and the partition 9 of the housing 3 by a predetermined offset amount.

Figure 2:
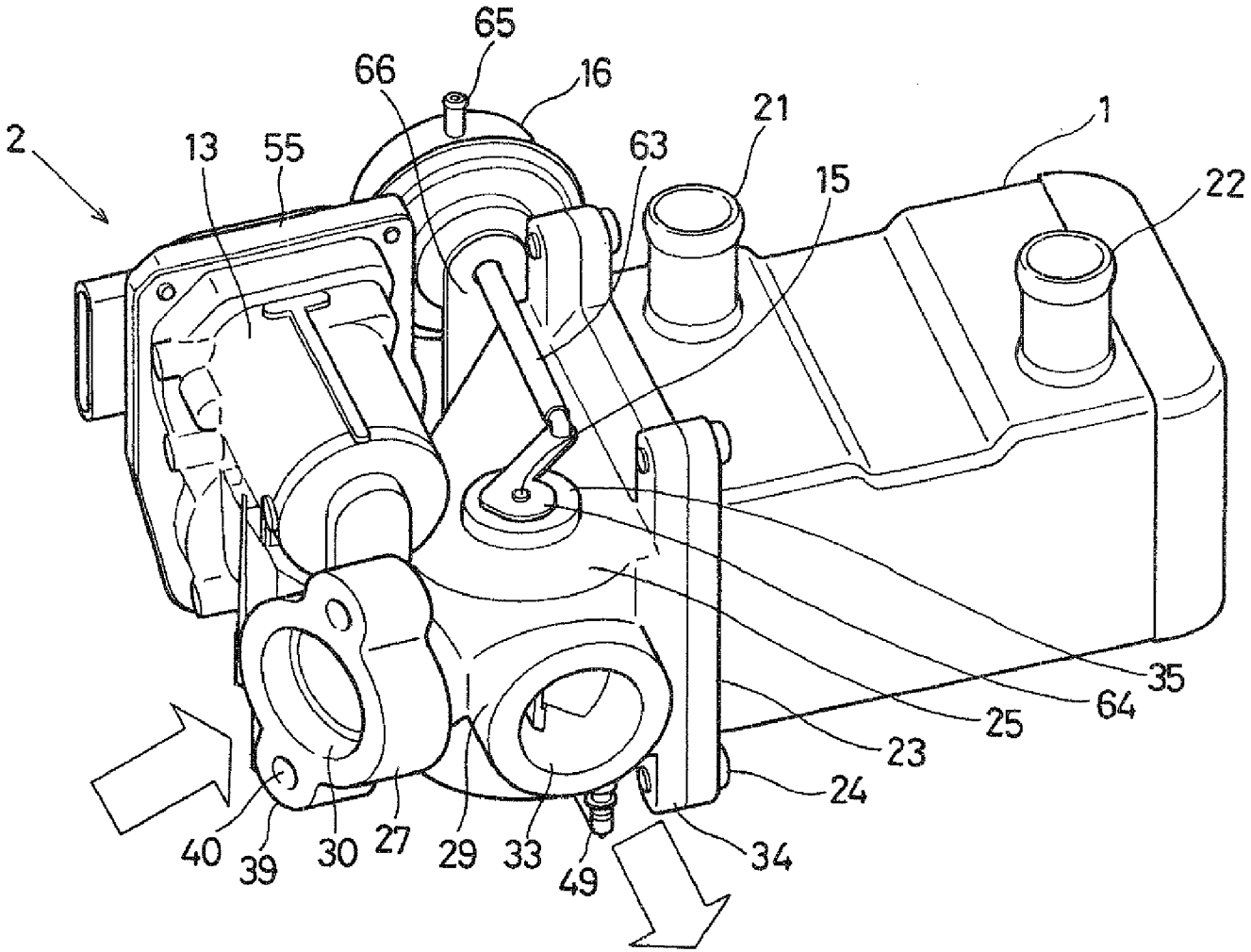
FIG. 2 is a perspective view showing the EGR module according to the first embodiment.

As shown in FIG. 2, the second actuator main body 16 is a negative-pressure operated actuator which generates driving force when being applied with negative pressure lower than atmospheric pressure. The second actuator main body 16 has a rod 63 straightly extended in the axial direction thereof. The rod 63 is connected with a link plate (motion converting unit) 64. The link plate 64 converts a linear motion of the rod 63 into a rotary motion of the valve shaft 15. The link plate 64 has an input end having a fitting hole. The fitting hole of the link plate 64 is fitted with an axial tip end of the rod 63 of the second actuator main body 16. The link plate 64 has an output end having a fitting hole. The fitting hole of the link plate 64 is fixed with an axial end of the valve shaft 15. The axial end of the valve shaft 15 protrudes outside through the plug 35.

The second actuator main body 16 has an interior space as a negative pressure chamber, in which negative pressure is applied, and an atmospheric pressure chamber opened to the atmosphere. The second actuator main body 16 accommodates a diaphragm and a spring. The diaphragm is an elastic component formed of rubber or the like to be in a film shape. The diaphragm airtightly partitions the interior space of the second actuator main body 16 into the negative pressure chamber and the atmospheric pressure chamber. The spring exerts biasing force to the diaphragm such that the spring biases the four-way selector valve 14 toward the bypass full-close position via the diaphragm. The second actuator main body 16 is connected with a negative pressure pipe 65 through which negative pressure is applied from an electromotive vacuum pump and a negative pressure control valve to the negative pressure chamber The negative pressure control valve has an electromagnetically controlled structure or an electrically controlled structure.

The negative pressure chamber of the second actuator main body 16 is applied with negative pressure from the electromotive vacuum pump through a negative-pressure regulator valve. The diaphragm is displaced in the thickness direction thereof by utilizing pressure difference between the negative pressure chamber and the atmospheric pressure chamber. Thereby, the rod 63, which is interlocked with the diaphragm, is axially moved. The axial movement of the rod 63 is transmitted to the valve shaft 15 via the link plate 64, so that the valve shaft 15 rotates by a predetermined angle. In this operation, the position of the four-way selector valve 14 is manipulated. The second actuator main body 16 is fixed to a bracket 66 attached to the housing 3.

The electric motor is a power source for the first actuator main body 13 of the EGRV. The negative-pressure regulator valve and the electromotive vacuum pump controls the negative pressure applied to the negative pressure chamber as a power source of the second actuator main body 16 of the EGR selector valve. The ECU controls supplying of electricity to the electric motor, the negative-pressure regulator valve, and the electromotive vacuum pump.

The ECU includes a microcomputer including a CPU, a storage unit, an input circuit, an output circuit, and the like. The CPU executes control processings and arithmetic processings. The storage unit is a memory such as a ROM and a RAM that stores programs and data. When an ignition switch (not shown) is turned ON (IG ON), the ECU electronically controls the flow control valve 11 and the four-way selector valve 14 in accordance with the control programs stored in the storage unit. When the ignition switch is turned OFF (IG OFF), the control of the ECU is forcedly terminated. The various sensors output sensor signals, and the sensor signals are A/D converted by an A/D converter The AND converted signals are input to the microcomputer of the ECU. The microcomputer is connected with a crank angle sensor, an accelerator position sensor, a cooling-water temperature sensor, an intake-air temperature sensor, an EGR flow sensor, the EGR temperature sensor 49, and the like. The EGR flow sensor is fixed to a sensor support portion provided in the sensor cover 55. The EGR temperature sensor 49 is inserted from the exterior of the block 25 of the housing 3 into the interior of the block 25.

The ECU compares a detection value of the EGR temperature sensor 49 with normal temperature (reference value), which is estimated from an engine operating condition such as the cooling-water temperature, the intake air temperature, the engine rotation speed, the accelerator position. When the ECU determines that the detection value of the EGR temperature sensor 49 is equal to or less than the reference value by a predetermined value, the ECU determines that the EGR cooler 1 to be deteriorated, and stores the state in the memory. That is, the EGR temperature sensor 49 also serves as a temperature sensor for determination of an abnormal deterioration of the EGR cooler 1. The function of the abnormal deterioration may be a part of an on board diagnosis (OBD) of an in-vehicle diagnosis device.

(Operation)

Next, operations of the EGR module incorporated in the EGR system are described with reference to FIGS. 1 to 6. When the ignition switch is turned ON (IG ON), and the engine operation is started, the ECU performs a feedback control of electricity supplied to the electric motor accommodated in the first actuator main body 13. In this condition, the ECU controls the electricity supplied to the electric motor such that the actual position of the EGRV detected using the EGR flow sensor coincides with a target position, which is set in accordance with the operating condition of the engine. The target position corresponds to a target EGR flow amount. When electricity is supplied to the electric motor, output shaft torque of the electric motor is transmitted as driving force to the valve shaft 12. Thus, the flow control valve 11 of the EGRV is manipulated from the full close position (FIG. 3) in the opening direction.

The flow control valve 11 of the EGRV is manipulated against resilience of the spring, and rotated to the valve position corresponding to the control target. In the present structure, exhaust gas flows out of the combustion chamber of each engine cylinder and a part of the exhaust gas is recirculated as hot EGR from the exhaust passage in an engine exhaust pipe into the intake passage in the engine intake pipe through an exhaust gas reflux path. The exhaust gas reflux path includes an EGR passage in the EGR pipe on the side of the exhaust passage, the first EGR passage 4 inside of the housing 3 of the EGR module, the U-shaped EGR passage 20 inside of the EGR cooler 1, the second EGR passage 5 inside of the housing 3 of the EGR module, and the EGR passage in the EGR pipe on the side of the intake passage. The hot EGR gas may be at temperature higher than 500° C., for example.

When the engine is in a normal operating condition, the ECU controls the negative-pressure regulator valve and the electromotive vacuum pump such that the switching position of the four-way selector valve 14 of the EGR selector valve is in the bypass full-close position. When electricity supply to the negative-pressure regulator valve and the electromotive vacuum pump is turned OFF, for example, the diaphragm is displaced to one side according to the biasing force of the spring in the second actuator main body 16; and the rod 63 of the second actuator main body 16 is positioned in a default position. In this condition, the seal portion of the four-way selector valve 14 is seated to the first valve seat portion 51. That is, the position of the four-way selector valve 14 is switched to the bypass full-close position.

When the position of the four-way selector valve 14 is switched to the bypass full-close position to be in the cooled EGR mode, the inner passage of the housing 3 is set to form a cooled EGR route. In the cooled EGR mode as shown in FIG. 4, EGR gas returns to the intake passage through the first EGR passage 4, the EGR cooler 1, and the second EGR passage 5 in order. Specifically, EGR gas flows from the EGR introduction port 30 into the housing 3. The EGR gas passes through the first communication passage 41, the inclined passage including the valve chamber 7 and the first communication passage 42, the first EGR port 31, and the U-shaped EGR passage 20 in the EGR cooler 1. The EGR gas further passes through the second EGR port 32, the bent passage including the second communication passage 43 and the valve chamber 7, and the second communication passage 44. Thus, the EGR gas flows out of the housing 3 through the EGR delivery port 33.

In the present condition, the position of the four-way selector valve 14 is in the cooled EGR mode in which the flow amount of the cooled EGR gas is maximum. Therefore, all the EGR gas flowing into the housing 3 of the EGR module returns to the intake passage after passing through the EGR cooler 1. Thereby, EGR gas is sufficiently cooled when passing through the EGR cooler 1, and reduced in temperature and density to be cooled EGR gas. Thereafter, the cooled EGR gas is mixed with inlet air in the intake passage.

In the present structure, temperature of combustion in the engine can be reduced, so that a toxic substance such as nitrogen oxide (NOx) in exhaust gas can be reduced while maintaining an engine output. In addition, EGR gas returning to the intake passage is cooled when passing through the EGR cooler 1, so that charging efficiency of EGR gas in the combustion chamber of the engine can be enhanced. Thus, emission of the engine can be further reduced. When the engine is started in a cold state or regeneration of a diesel particulate filter (DPF) is performed, the ECU controls the negative-pressure regulator valve and the electromotive vacuum pump such that the switching position of the four-way selector valve 14 of the EGR selector valve is in the bypass full-open position. When electricity supply to the negative-pressure regulator valve and the electromotive vacuum pump is turned ON, for example, negative pressure is applied to the negative pressure chamber in the second actuator main body 16.

A diaphragm 60 moves to the other side corresponding to the pressure difference between pressure in the negative pressure chamber and pressure in the atmospheric chamber, so that the rod 63 of the second actuator main body 16 moves to a full-lift position. The link plate 64 rotates around the axial center of the valve shaft 15 in conjunction with the linear motion of the rod 63. The valve shaft 15 fixed to the link plate 64 rotates around the rotation axis of the valve shaft 15 in conjunction with the rotation of the link plate 64. Thereby, the four-way selector valve 14 rotates around the rotation axis of the valve shaft 15. The seal portion of the four-way selector valve 14 is lifted from the first valve seat portion 51, and is seated to the second valve seat portion 52. That is, the position of the four-way selector valve 14 is switched to the bypass full-open position.

When the position of the four-way selector valve 14 is switched to the bypass full-open position to be in the hot EGR mode, the inner passage of the housing 3 is set to form a hot EGR route. In the hot EGR mode as shown in FIG. 5, EGR gas returns to the intake passage by bypassing through the bypass passage 6. Specifically, EGR gas flows into the housing 3 through the EGR introduction port 30. The EGR gas further flows through the first communication passage 41, the bent passage including the valve chamber 7, and the second communication passage 44. Thus, the EGR gas flows out of the housing 3 through the EGR delivery port 33.

In the present condition, the position of the four-way selector valve 14 is in the hot EGR mode in which the flow amount of the hot EGR gas is maximum. Therefore, all the EGR gas flowing into the housing 3 of the EGR module returns to the intake passage after bypassing the EGR cooler 1. In the present operation, intake air can be sufficiently warmed when the engine is started in a cold state, so that combustion in the engine can be enhanced. Thus, exhaust of hydrocarbon (HC) and smoke can be reduced. When regeneration of the DPF is performed, hot EGR gas can be supplied to the intake passage. Thereby, intake air drawn into the combustion chamber can be increased, and exhaust gas flowing through the DPF can be effectively heated. In the present operation, hot exhaust gas can be supplied to the DPF, thereby the DPF can be heated such that temperature of a particulate matter (PM) can be increased to be combustion temperature in a range between 500° C. and 650° C., for example. Thus, regeneration of the DPF can be conducted with low fuel consumption. In addition, emission can be further reduced by the regeneration of the DPF.

When temperature of intake air is reduced by cooling EGR gas, nitrogen oxide (NOx) may be reduced from exhaust gas. However in a condition where engine speed is low and/or load of the engine is low, hydrocarbon (HC) in exhaust gas may increase when temperature of intake air is reduced by cooling EGR gas. Accordingly, the switching position of the four-way selector valve 14 is set at the mixing position, in which the rotation angle of the four-way selector valve 14 is controlled at a proper angle between the bypass full-close position and the bypass full-open position, according to the engine operating condition.

When the position of the four-way selector valve 14 is switched to the mixing position in a hot-cooled EGR mixing mode, the inner passage of the housing 3 is set to form a hot-cooled EGR gas mixing route. As shown in FIG. 6, EGR gas flows into the housing 3 through the EGR introduction port 30. In the present hot-cooled EGR mixing mode, the EGR gas further flows through both the cooled EGR route, which includes the first EGR passage 4 and the EGR cooler 1, and the hot EGR route, which includes the second EGR passage 5 and the bypass passage 6. Thus, the EGR gas flows out of the housing 3 through the EGR delivery port 33. In the present operation, temperature of EGR gas returning to the intake passage can be properly controlled by manipulating a mixing ratio between mixture of the cooled EGR gas passing through the first EGR passage 4, the EGR cooler 1, and the second EGR passage 5 and the hot EGR gas passing through the bypass passage 6. Thus, NOx and HC in exhaust gas can be simultaneously reduced. The DPF may be regenerated in the present hot-cooled EGR mixing mode.

(Effects)

In the EGR module incorporated in the EGR system of the present embodiment, the center of the valve shaft 15 of the four-way selector valve 14 is offset from the center axis of the EGR cooler 1 and the center axis X of the cooler mount face 26 to the center axis Y of the second EGR port 32 by a predetermined offset amount. In addition, the rotation axis of the valve shaft 15 is offset away from the EGR cooler 1 and the partition 9 of the housing 3 by a predetermined offset amount.

In the present structure, the rotation axis of the valve shaft 15 of the four-way selector valve 14 and the bypass passage 6 can be located away from both the cooler mount face 26 of the housing 3 and the partition 9, which extends from the cooler mount face 26 to the portion in the vicinity of the valve chamber 7. Therefore, the cooler mount face 26 can be restricted from increasing in temperature due to transmission of heat from EGR gas passing through the bypass passage 6 including the first communication passage 41, the valve chamber 7, and the second communication passage 44 in the hot EGR mode. In the present structure, the EGR cooler 1 attached to the cooler mount face 26 can be restricted from transmitted with heat of hot EGR gas, which flows through the bypass passage 6 in the hot EGR mode. Therefore, a cooling performance of the EGR cooler 1 can be maintained in the cooled EGR mode. Thus, emission can be reduced from exhaust gas in the cooled EGR mode.

In addition, the rotation axis of the valve shaft 15 of the four-way selector valve 14 and the bypass passage 6 can be located away from the cooler mount face 26 and the partition 9 of the housing 3. Therefore, heat of hot EGR gas, which flows through the bypass passage 6, can be restricted from exerting influence to cooled EGR gas, which flows through the second EGR passage 5 including the second communication passage 43 and the valve chamber 7, in the hot-cooled EGR mixing mode. Thus, temperature of cooled EGR gas, which flows through the second EGR passage 5 can be maintained. Therefore, temperature control of EGR gas, which returns to the intake passage, can be facilitated when hot EGR gas and cooled EGR gas are mixed in the valve chamber 7 of the housing 3. In addition, temperature control of the EGR gas can be facilitated when hot EGR gas and cooled EGR gas are mixed in the second communication passage 44 and the exhaust gas reflux path in the EGR pipe on the side of the intake passage downstream of the valve chamber 7 with respect to the flow direction of EGR gas. Thus, emission can be reduced from exhaust gas in the hot-cooled EGR mixing mode. In the present embodiment, the EGR module includes the housing 3 joined with the EGR cooler 1 having the U-turn passage. The housing 3 has the first and second EGR passages 4, 5 defining a shortcut through which EGR gas passes to bypass the EGR cooler 1, thereby being recirculated to the intake passage.

Figure 9:
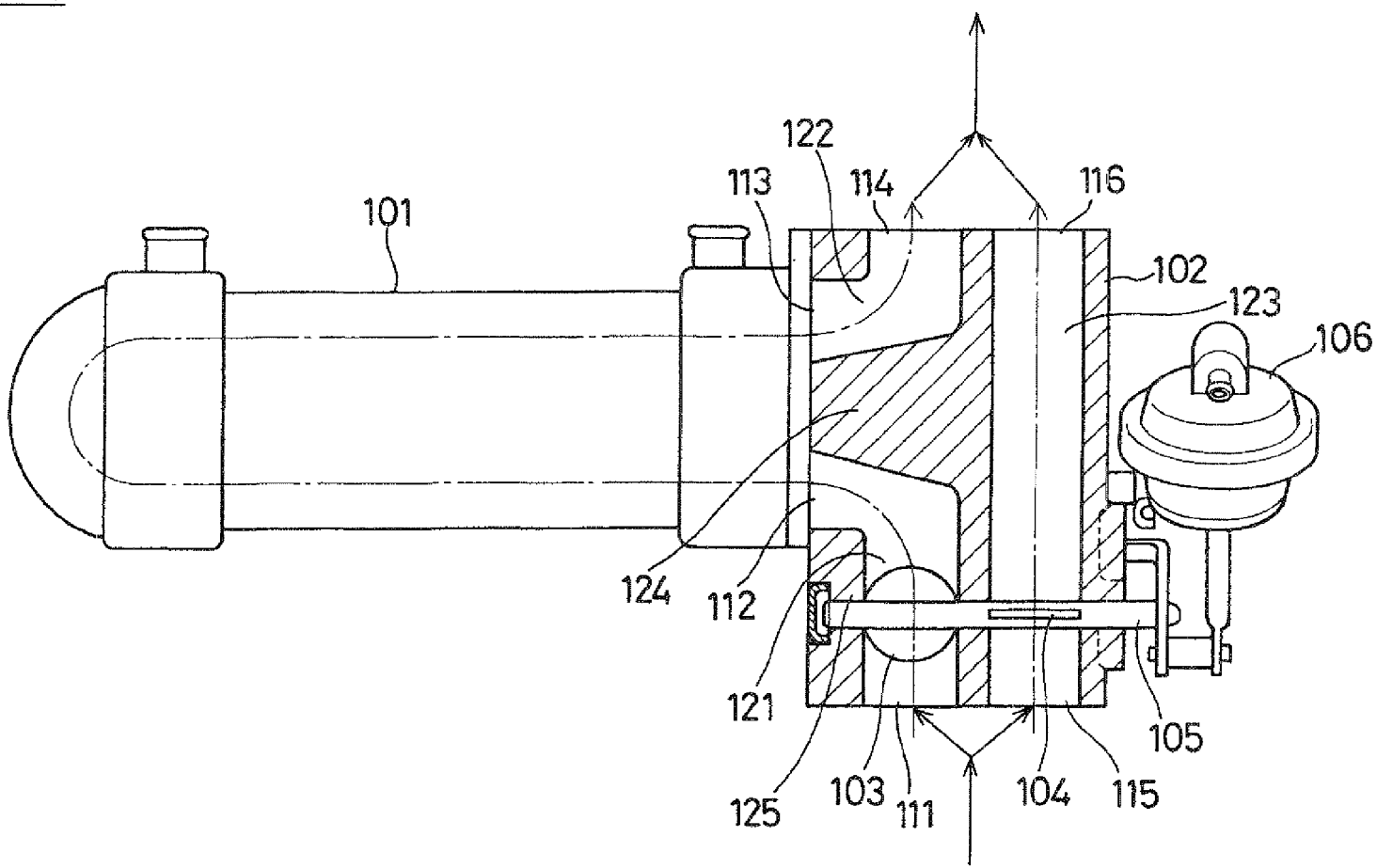
FIG. 9 PRIOR ART
FIG. 9 is a sectional view showing an EGR module according to a prior art.

As referred to FIG. 9 the EGR module disclosed in EP0987427 has the structure in which the cooler inlet gas passage 121, the cooler outlet gas passage 122, and the bypass passage 123 are in parallel. In contrast, in the present embodiment, the housing 3 of the EGR module can be downsized compared with the housing 102 of the EGR module in EP0987427. Thus, the EGR module, which includes the EGR cooler 1 and the valve unit 2, can be downsized. Therefore, a mounting space needed in an engine room for the EGR module can be reduced. Thus, the EGR module can be enhanced in mountability to an engine room of a vehicular such as an automotive. In particular, the EGR module can be enhanced in mountability to an engine.

In the present structure, the EGR introduction port 30, the EGR delivery port 33, and the first and second communication passages 41, 44, can be commonly used as the first and second EGR passages 4, 5, which communicate with the EGR cooler 1, and the bypass passage 6, which bypasses the EGR cooler 1. Therefore, a bypass passage need not be exclusively provided in the housing 3. Thus, the number of exhaust ports can be reduced compared with the EGR module in EP0987427. In addition, the number of switching valves can be reduced compared with the EGR module in EP0987427. Therefore, the housing 3 of the EGR module can be downsized. In addition, the length of the rotation axis of the valve shaft 15 can be reduced with respect to the axial direction thereof. Thus, the EGR module can be enhanced in mountability to an engine room of a vehicular such as an automotive. In particular, the EGR module can be enhanced in mountability to an engine.

In the present invention, the four-way selector valve 14 of the EGR selector valve is a butterfly valve constructed of valve plates each being in a rectangular shape. The valve plates of the four-way selector valve 14 are extended toward both sides perpendicularly to the rotation axis of the valve shaft 15. That is, the valve plates are extended toward both sides along the radial direction of the rotation axis of the valve shaft 15. The four-way selector valve 14 rotates around the rotation axis of the valve shaft 15 so as to continuously manipulate the opening area of the two first and second EGR passages 4, 5 and the opening area of the bypass passage 6. That is, the four-way selector valve 14 continuously manipulates the flow of cooled EGR gas and the flow of hot EGR gas.

In the present structure, the cooled EGR gas cooled by the EGR cooler 1 and the hot EGR gas bypassing the EGR cooler 1 can be efficiently mixed in the vicinity of the valve chamber 7, for example, inside the second communication passage 44. Therefore, the temperature control of the EGR gas returning to the intake passage can be facilitated, so that emission can be effectively reduced.

In the present embodiment, the EGRV and the EGR selector valve commonly share the interior of the housing 3 in the EGR module. In particular, the first EGR passage 4 has the inclined passage includes the valve chamber 7 and the first communication passage 42. The inclined passage substantially linearly extends from a portion in the vicinity of the EGR introduction port 30 toward the first EGR port 31 The inclined passage of the first EGR passage 4 is inclined with respect to the center axis of the first EGR port 31 passing through the center of the first EGR port 31.

In the present structure, exhaust gas flows from the EGR pipe on the side of an exhaust passage into the first EGR passage 4, and the exhaust gas further flows substantially straight along the axis passing through the center of the inclined passage of the first EGR passage 4. That is, the exhaust gas smoothly passes through the valve chamber 7 and the first communication passage 42 substantially along the valve face of the four-way selector valve 14, and flows into the inlet of the EGR cooler 1 without bending at a right angle. In general, the cooled EGR mode is mainly used compared with the hot EGR mode in an engine operation. That is, in a normal operation, EGR gas is cooled through the EGR cooler 1 and recirculated into the intake passage, rather than being bypassed the EGR cooler 1. In the present structure, pressure loss of ERG gas can be reduced effectively in the cooled EGR mode, which is normally set.

Furthermore, the axis of the portion of the partition 9 on the side of the cooler mount face 26 of the housing 3 is the same as the center axis of the EGR cooler 1. That is, the portion of the partition 9 on the side of the cooler mount face 26 extends continuously from the center axis of the EGR cooler 1. The center axis of the EGR cooler 1 passes through the center of the EGR cooler 1. In the present structure, the partition 9 of the housing 3 is capable of equally divide two of the first and second EGR ports 31, 32 adjacent to the cooler mount face 26 of the housing 3. In the present structure, pressure loss of EGR gas flow can be suppressed in the cooled EGR mode in which the EGR gas is cooled by passing through the EGR cooler 1, and the cooled EGR gas returns to the intake passage.

In the present embodiment, the center axis of the valve chamber 7 of the housing 3 and the rotation axis of the valve shaft 15 of the four-way selector valve 14 are offset from both the center axis of the EGR cooler 1 and the center axis X of the cooler mount face 26 to the center axis Y of the second EGR port 32 by the predetermined offset amount.

In the present embodiment, as shown in FIG. 1, an imaginary line A is extended from the lateral side of the housing 3 perpendicularly to the cooler mount face 26 of the housing 3. That is, the imaginary line A is extended from the lateral side of the housing 3 in parallel with both the center axis of the EGR cooler 1 and the center axis X of the cooler mount face 26. An imaginary lines B is extended from the actuator mount face 36 of the inlet pipe 27 of the housing 3 in parallel with both the center axis of the EGR cooler 1 and the center axis X of the cooler mount face 26. The imaginary lines A, B therebetween define an actuator mount space S in the housing 3 of the EGR module, and the actuator mount space S is adapted to accommodating the first actuator main body 13.

In the present structure, the actuator mount space S can be easily secured around the housing 3. Therefore, the EGR module integrated with the EGR cooler 1, the EGRV, and the EGR selector valve can be downsized, compared with EP0987427, in which the EGR module includes the housing 102 significantly greater than the EGR cooler 101 in width. Furthermore, the size, in particular the width of the housing 3, which is mounted with the first actuator main body 13, can be downsized. Thus, the EGR module can be enhanced in mountability to an engine room of a vehicular such as an automotive. In particular, the EGR module can be enhanced in mountability to an engine.

Second Embodiment

Figure 7:
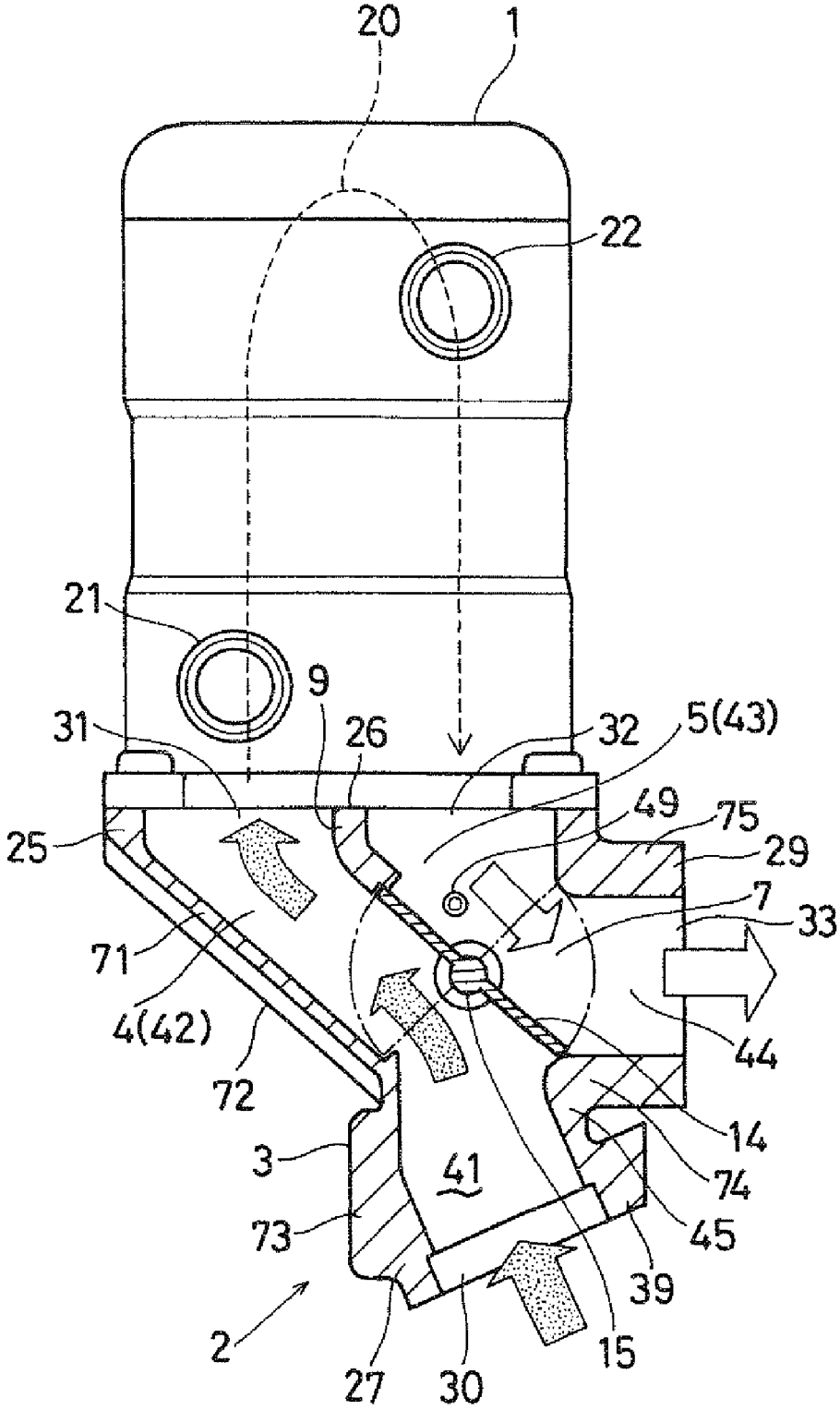
FIG. 7 is a sectional view showing an EGR module in a cooled EGR mode, according to a second embodiment.
Figure 8:
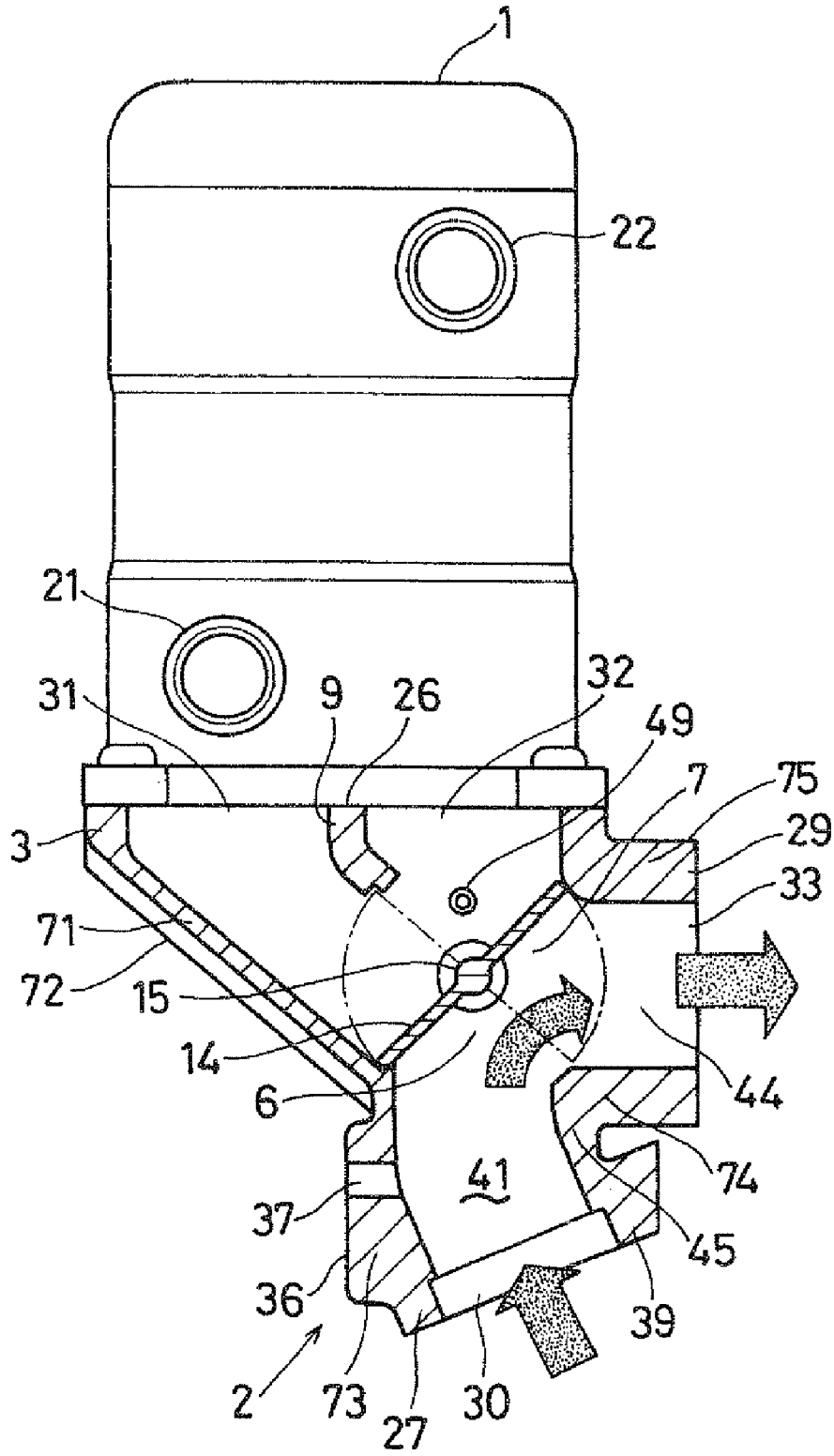
FIG. 8 is a sectional view showing the EGR module in a hot EGR mode, according to the second embodiment.

As shown in FIGS. 7, 8, in the present embodiment, the block 25 of the housing 3 has a cooler introduction passage wall (housing wall section) 71 that partitions the first EGR passage 4 including the valve chamber 7 and the first communication passage 42 from the exterior of the block 25. The outer surface of the cooler introduction passage wall 71 is provided with a radiating portion. The radiating portion is exposed to the outside of the cooler introduction passage wall 71. The radiating portion of the cooler introduction passage wall 71 is provided with multiple radiating fins (cooling fins) 72. The radiating fins 72 project from the outer surface of the cooler introduction passage wall 71 to the opposite side of the first EGR passage 4 including the valve chamber 7 and the first communication passage 42. The inlet pipe 27 of S the housing 3, the outlet pipe 29, and the Y-shaped partition wall 45 include bypass passage walls (housing wall portions) 73 to 75 each partitioning the bypass passage 6 from the outside of the housing 3. The bypass passage 6 includes the EGR introduction port 30, the first communication passage 41, the valve chamber 7, the second communication passage 44, and the EGR delivery port 33.

In the cooled EGR mode as shown in FIG. 7, temperature of cooled EGR gas flowing into the EGR cooler 1 is preferably lowered as much as possible. By contrast, in the hot EGR mode as shown in FIG. 8, temperature of hot EGR gas is preferably maintained as much as possible. That is, the preferable conditions in the cooled EGR mode and the hot EGR mode are opposite from each other. In the present embodiment, the housing 3 is reduced in thickness, in view of the foregoing preferable conditions.

Specifically, the thickness of the cooler introduction passage wall 71 of the housing 3 is thinner than the bypass passage walls 73 to 75 by predetermined thickness. In the present structure, heat resistance relative to hot EGR gas passing through the first EGR passage 4 including the valve chamber 7 and the first communication passage 42 is reduced. Furthermore, heat dissipation from the hot EGR gas to the exterior of the block 25 can be increased. Thus, EGR gas can be sufficiently cooled, and the sufficiently cooled EGR gas can be mixed with intake air flowing through the intake passage. In the present structure, engine combustion temperature can be reduced, so that a toxic substance such as Nox can be reduced from exhaust gas, without reducing an engine output. Therefore, reduction of emission can be further enhanced in the cooled EGR mode.

Furthermore, the radiating fins 72 are provided to the radiating portion of the cooler introduction passage wall 71. The radiating fins 72 project from the outer surface of the cooler introduction passage wall 71 toward the opposite side of the first exhaust gas passage. In the present structure, a contact area between the radiating portion and air flowing over the outer surface of the cooler introduction passage wall 71 increases That is, the radiation area of the radiating portion increases. Therefore, hot EGR gas can be efficiently cooled by using air flowing over the outer surface of the cooler introduction passage wall 71 when the hot EGR gas passes through the first EGR passage 4 including the valve chamber 7 and the first communication passage 42.

Therefore, cooled EGR gas, which returns to the intake passage, can be air-cooled with not only the EGR cooler 1 but also air flowing over the outer surface of the cooler introduction passage wall 71. Thus, the EGR cooler 1 can be downsized. In addition, the EGR module constructed of the EGR cooler 1 and the valve unit 2 can be also reduced in size by downsizing the EGR cooler 1. Thus, the EGR module can be enhanced in mountability to an engine room of a vehicular such as an automotive. In particular, the EGR module can be enhanced in mountability to an engine.

The bypass passage walls 73 to 75 of the housing 3 may be thicker than the cooler introduction passage wall 71 by a predetermined thickness. In the present structure, thermal capacity of the housing 3 can be increased relative to hot EGR gas passing through the bypass passage 6, specifically, the EGR introduction port 30, the first communication passage 41, the valve chamber 7, the second communication passage 44, and the EGR delivery port 33. Therefore, heat dissipation to the exterior of the housing 3 can be reduced. Thus, temperature of hot EGR gas returning to the intake passage can be maintained, so that intake air flowing to the engine can be sufficiently heated when the engine is started in a cold condition. In the present structure, combustion in the engine can enhanced, and emission of the engine can be reduced. Thus, a toxic substance such as hydrocarbon (HC) contained in exhaust gas can be reduced, so that smoke can be reduced from exhaust gas. An air heat insulating layer may be provided inside the bypass passage walls 73 to 75 of the housing 3 for heat insulation between hot EGR gas and ambient air.

(Modification)

In the above embodiments, the EGRV includes the electric actuator for driving the flow control valve 11 as the valve element of the EGRV and the electric actuator includes the electric motor and the transmission device such as reduction gears. Alternatively, the EGRV may include an electromagnetic actuator or a negative pressure controlled actuator for driving the flow control valve 11. In this case, the negative pressure controlled actuator may include a negative pressure control valve and an electric vacuum pump. The EGRV may not be mounted to the EGR module. In the above embodiments, the EGRV is provided upstream of the EGR cooler 1 with respect to the flow direction of EGR gas. Alternatively, the EGRV may be provided downstream of the EGR cooler 1 with respect to the flow direction of EGR gas.

In the above embodiments, the second actuator main body 16 is the negative pressure controlled actuator provided with the negative-pressure regulator valve and the electromotive vacuum pump for driving the four-way selector valve 14 as the valve element of the EGR selector valve. Alternatively, the second actuator main body 16 may include an electromagnetic actuator or an electric actuator for driving the four-way selector valve 14. In this case, the electric actuator may include an electric motor and a power transmission device such as reduction gears. The housing 3 of the valve unit 2 may be provided with a valve biasing device such as a spring, which biases the four-way selector valve 14 of the EGR selector valve of the valve unit 2 to the closing direction such that the four-way selector valve 14 closes the bypass passage 6, for example.

In the present embodiment, the EGR module is provided with the EGR cooler 1 of the U-turn flow type, and EGR gas (exhaust gas) flows through the U-shaped passage inside the EGR cooler 1. Alternatively, the EGR cooler 1 may have an S-shaped passage or an I-shaped passage, and EGR gas (exhaust gas) may flow through the S-shaped passage or the I-shaped passage inside the EGR cooler 1. In this case, an outlet tank of the exhaust gas cooler connects with the second EGR port 32 of the housing 3 through a pipe, which does not conduct heat exchange.

In the above embodiments, the valve chamber 7 communicates with the EGR introduction port 30 through the first communication passage 41. Alternatively, the first communication passage 41 may be omitted, and the valve chamber 7 may communicate directly with the EGR introduction port 30. In the above embodiments, the valve chamber 7 communicates with the first EGR port 31 through the first communication passage 42. Alternatively, the first communication passage 42 may be omitted, and the valve chamber 7 may communicate directly with the first EGR port 31.

In the above embodiments, the valve chamber 7 communicates with the second EGR port 32 through the second communication passage 43. Alternatively, the second communication passage 43 may be omitted, and the valve chamber 7 may communicate directly with the second EGR port 32. In the above embodiments, the valve chamber 7 communicates with the EGR delivery port 33 through the second communication passage 44. Alternatively, the second communication passage 44 may be omitted, and the valve chamber 7 may communicate directly with the EGR delivery port 33.

In the above embodiments, the sectional shapes of the EGR introduction port 30 and the EGR delivery port 33 are circular shapes. Alternatively, at least one of the sectional shapes of the EGR introduction port 30 and the EGR delivery port 33 may be a square shape or a rectangular shape. The sectional shape of the EGR introduction port 30 may be different from the sectional shape of the EGR delivery port 33.

In the above embodiments, the sectional shapes of the two first and second EGR ports 31, 32 are rectangular shapes. Alternatively, at least one of the sectional shapes of the two first and second EGR ports 31, 32 may be a square shape or a circular shape. The sectional shape of the first EGR port 31 may be different from the sectional shape of the second EGR port 32.

The above structures of the embodiments can be combined as appropriate.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. An exhaust gas recirculation apparatus for recirculating exhaust gas of an engine from an exhaust passage to an intake passage, the apparatus comprising:

an exhaust gas cooler for cooling exhaust gas recirculated to the intake passage;

a housing connected with the exhaust gas cooler via a cooler mount face, the housing having a valve chamber communicated with four exhaust ports including inlet and outlet exhaust ports, the inlet and outlet exhaust ports being adjacent to each other and opened in the cooler mount face, the inlet exhaust port communicating with an inlet of the exhaust gas cooler, the outlet exhaust port communicating with an outlet of the exhaust gas cooler;

a selector valve rotatably accommodated in the valve chamber for controlling communication among the four exhaust ports; and a rotation axis rotatably supporting the selector valve, wherein the housing has a partition extending from the cooler mount face close to the valve chamber, the partition dividing the inlet and outlet exhaust ports, the housing has a first exhaust passage that includes the inlet exhaust port, for leading exhaust gas from the engine into the exhaust gas cooler through the valve chamber, the housing further has a second exhaust passage that includes the outlet exhaust port, for recirculating exhaust gas, which is cooled in the exhaust gas cooler, to the intake passage through the valve chamber, the housing further has a bypass passage for leading exhaust gas from the engine through the valve chamber to bypass the exhaust gas cooler, the rotation axis is substantially perpendicular to a cooler-mount-face axis passing through a center of the cooler mount face, the rotation axis is offset from a center axis of the exhaust gas cooler and the cooler-mount-face axis of the cooler mount face toward a center axis of the second exhaust passage by a first predetermined offset amount, and the rotation axis is offset to be farther away from the exhaust gas cooler than the partition of the housing by a second predetermined offset amount.

2. The apparatus according to claim 1, wherein the first exhaust passage is inclined with respect to a center axis of the inlet exhaust port, and the first exhaust passage substantially linearly extends close to the inlet exhaust port.

3. The apparatus according to claim 1, wherein the rotation axis is offset from the cooler-mount-face axis toward an outlet-exhaust-port axis passing through a center of the outlet exhaust port.

4. The apparatus according to claim 1, wherein the valve chamber has a valve-chamber axis passing through a center of the valve chamber, and the valve-chamber axis is offset from the cooler-mount-face axis toward a an outlet-exhaust-port axis passing through a center of the outlet exhaust port.

5. The apparatus according to claim 1, further comprising:

a flow control valve provided to the housing for controlling a flow of exhaust gas recirculated to the intake passage; and an actuator provided to the housing for driving the flow control valve.

6. The apparatus according to claim 5, wherein the housing and an imaginary line, which is extended along a lateral side of the housing perpendicularly to the cooler mount face, therebetween define an actuator mount space for accommodating the actuator, and the imaginary line is in parallel with an exhaust-gas-cooler axis passing through a center of the exhaust gas cooler.

7. The apparatus according to claim 5, wherein the housing has an actuator mount face via which the housing is connected with the actuator, and the housing is formed of a metallic material having heat resistance higher than heat resistance of the actuator.

8. The apparatus according to claim 1, wherein the housing has a bypass passage wall separating the bypass passage from an exterior of the housing, the housing further has a cooler introduction passage wall separating the first exhaust passage from the exterior of the housing, and the bypass passage wall is thicker than the cooler introduction passage wall.

9. The apparatus according to claim 1, wherein the housing has a bypass passage wall separating the bypass passage from an exterior of the housing, the housing further has a cooler introduction passage wall separating the first exhaust passage from the exterior of the housing, and the cooler introduction passage wall is thinner than the bypass passage wall.

10. The apparatus according to claim 8, wherein the housing has a radiating portion exposed to an outer surface of the cooler introduction passage wall, and the radiating portion is adapted to dissipate heat of exhaust gas, which flows through the first exhaust passage, to air passing over an outer surface of the cooler introduction passage wall.

11. The apparatus according to claim 1, wherein the partition of the housing has an end located in the valve chamber, and the rotation axis is located farther from the exhaust gas cooler than the end of the partition.

12. The apparatus according to claim 11, wherein the end of the partition extends from the partition in an extended direction, and the rotation axis is spaced from the end of the partition in the extended direction.

13. The apparatus according to claim 12, wherein the rotation axis is located on an extension line extended from the end of the partition in the extended direction.

* * * * *